US005802611A

United States Patent [19]

McKenzie et al.

[11] Patent Number: 5,802,611

[45] Date of Patent: Sep. 8, 1998

[54] RELEASABLE CLOTHING WITH TEMPERATURE SENSOR FOR BEDRIDDEN PATIENTS

[76] Inventors: Melody McKenzie; Michelle Gainor, both of 1908 E. 19th St., Lot W-79, Lawrence, Kans. 66046

[21] Appl. No.: 972,188

[22] Filed: Nov. 18, 1997

[51] Int. Cl.[6] ..... A41D 1/06; A41D 13/12

[52] U.S. Cl. ..... 2/69; 2/79; 2/83; 2/114; 2/227; 2/238; 600/549

[58] Field of Search ..... 2/69, 77, 79, 80, 2/83, 94, 102, 106, 111, 114, 113, 115, 125, 227, 228, 238; 600/549, 555; 374/141, 161, 208, 162; 349/199, 20

[56] References Cited

U.S. PATENT DOCUMENTS

| | | | |
|---|---|---|---|
| 3,648,764 | 3/1972 | Starr | 165/32 |
| 3,830,224 | 8/1974 | Vanzetti et al. | 600/549 |
| 4,258,440 | 3/1981 | McGowan | 3/227 |
| 4,435,180 | 3/1984 | Leeper | 604/896 |
| 4,437,471 | 3/1984 | Nelson | 600/549 |
| 4,524,778 | 6/1985 | Brown, Jr. et al. | 600/549 |
| 4,747,413 | 5/1988 | Bloch | 600/549 |
| 4,763,112 | 8/1988 | Hsieh | 600/540 |
| 4,914,756 | 4/1990 | Grassick | 2/227 |
| 5,026,552 | 6/1991 | Gueret et al. | 424/401 |
| 5,062,159 | 11/1991 | Jakub | 2/114 |
| 5,069,907 | 12/1991 | Mixon et al. | 2/901 |
| 5,105,067 | 4/1992 | Brekkestran et al. | 2/69 |
| 5,174,656 | 12/1992 | Dotan | 374/163 |
| 5,181,905 | 1/1993 | Flam | 374/161 |
| 5,222,258 | 6/1993 | Mucci et al. | 2/114 |
| 5,291,181 | 3/1994 | DePonte | 600/549 |
| 5,315,716 | 5/1994 | Baum | 2/227 |
| 5,392,466 | 2/1995 | Chou et al. | 2/114 |
| 5,453,268 | 9/1995 | Ueno et al. | 2/901 |
| 5,546,955 | 8/1996 | Wilk | 600/549 |
| 5,553,323 | 9/1996 | Chou et al. | 2/114 |
| 5,603,123 | 2/1997 | Chupa | 2/114 |
| 5,611,087 | 3/1997 | Adkins | 2/227 |
| 5,692,238 | 12/1997 | Watson, Jr. | 2/170 |

*Primary Examiner*—Amy B. Vanatta
*Attorney, Agent, or Firm*—Kenneth L. Tolar

[57] ABSTRACT

The present invention relates to clothing specifically designed for incapacitated or bedridden patients. The clothing includes trousers, shorts, a shirt and an undergarment each having separable seams allowing the garments to be easily removed from a patient with minimal movement or manipulation of the patient's body. Each garment has an integrated moisture detection means which will emit an audible alarm upon sensing a predetermined amount of moisture. The clothing also has a temperature detecting means, for instantaneously providing the patient's body temperature, removably attached thereto. Preferably, each garment is constructed with a fabric like material that has been pretreated with an antibacterial, an anti-fugal or an antiviral agent in order to minimize bed sores, skin rashes and other skin irritations.

13 Claims, 3 Drawing Sheets

RELEASABLE CLOTHING WITH TEMPERATURE SENSOR FOR BEDRIDDEN PATIENTS

BACKGROUND OF THE INVENTION

The present invention relates to clothing designed for invalids, bedridden patients, those confined to wheelchairs and similarly handicapped people. The inventive device comprises segmented shirts, trousers, undergarments and similar items of clothing made from a fabric material pretreated with an anti-bacterial, an anti-fungal or an anti-viral agent. The garments are designed to be easily separated and removed from a patient without having to move the patient's limbs. Furthermore, the clothing has an integrated moisture alarm and a temperature detection means thereon.

DESCRIPTION OF THE PRIOR ART

Quick release clothing designed for hospital patients and the like are generally known in the prior art. For example, U.S. Pat. No. 5,062,159 issued to Jakub relates to a patient's hospital gown comprising a wrap around lower portion secured with a waist drawstring and a series of releasable fasteners along the overlapped seam. Releasable fasteners are also provided on the front, shoulders and waist area.

U.S. Pat. No. 5,222,258 issued to Mucci relates to a hospital garment such as a shirt or pants having openable seams on both limb portions and on the front portion.

U.S. Pat. No. 5,315,716 issued to Baum relates to removable pants having a releasable seam along the outside of each leg.

U.S. Pat. No. 5,392,466 issued to Chou et al relates to an upper garment for patients comprising a first half-shirt component removably attached to a second half-shirt component allowing the shirt to be easily removed from an invalid patient.

Although releasable clothing designed for invalid patients exists in the prior art, these devices do not disclose all of the features and advantages of the present invention. The present invention provides a complete set of quick release clothing including a shirt, trousers, shorts and an undergarment. The trousers, shorts and undergarment are equipped with an integrated moisture detection means that audibly alerts a nurse or care provider that the patient has soiled his or her clothing. Each garment has an integral temperature detection means allowing the care provider to quickly obtain the patient's body temperature. The fabric used to make each garment is pretreated with an anti-bacterial, an anti-viral or an anti-fungal agent to minimize skin disorders.

SUMMARY OF THE INVENTION

The present invention relates to various clothing articles specifically designed for bedridden, incapacitated or otherwise handicapped patients allowing the clothing articles to be removed therefrom with minimal movement of the patient's body. The clothing relates primarily to trousers, a shirt, shorts and an undergarment each having one or more releasable seams formed using a plurality of aligned snaps and mating apertures. Accordingly, the releasable seams allow the garment to be separated and removed without having to manipulate the patient's limbs which could result in pain or injury to the patient.

The trousers, shorts and shirt component each have an aperture preferably on a limb portion for receiving a liquid crystal thermometer a side of which contacts the patient's skin. A continuous elastic band surrounds the patient's limb and engages the top surface of the thermometer to retain it within the aperture. Attached to the interior surface of the undergarment, shorts and trousers proximal the groin area is a conventional moisture detector in communication with a speaker which emits an audible alarm upon sensing a predetermined amount of moisture. The material used to make each garment is pretreated with an anti-bacterial, an anti-viral or an anti-fungal agent to minimize rashes, bed sores and other similar skin irritations. It is therefore an object of the present invention to provide clothing which may be quickly and easily removed from a bedridden patient with minimal movement of the patient's limbs or body.

It is yet another object of the present invention to provide clothing having an integrated body temperature sensing means thereon.

It is yet another object of the present invention to provide clothing having integrated moisture sensing means thereon.

It is yet another object of the present invention to provide clothing made from a fabric material which is pretreated with an anti-bacterial, an anti-fungal or an anti-viral agent to minimize minor skin irritations. Other objects, features and advantages of the present invention will become readily apparent to those skilled in the art from the following detailed description of the preferred embodiment when considered with attached drawings and the appended claims.

DESCRIPTION OF THE PREFERRED EMBODIMENT

Figure 1:
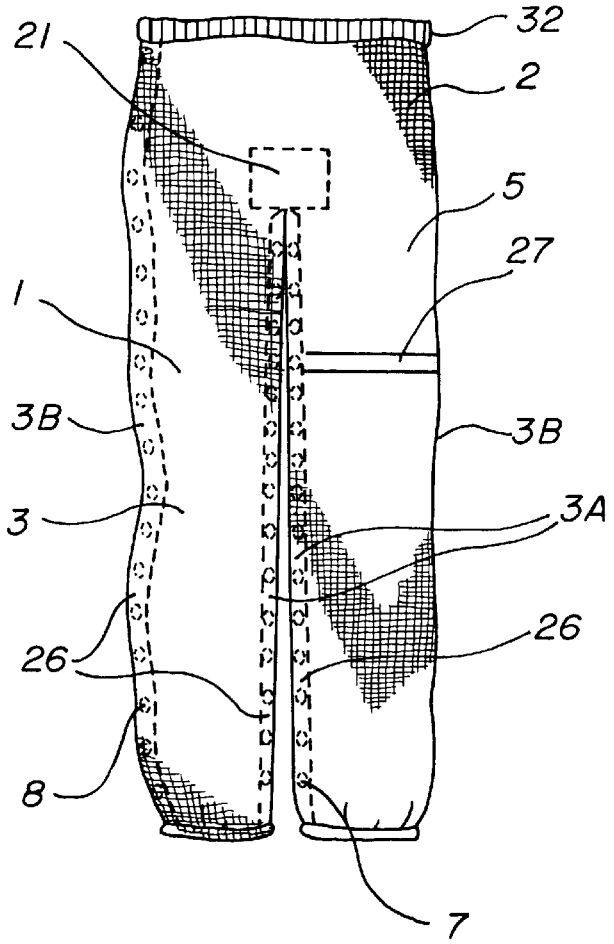
FIG. 1 is a perspective view of the trousers according to the present invention.
Figure 2:
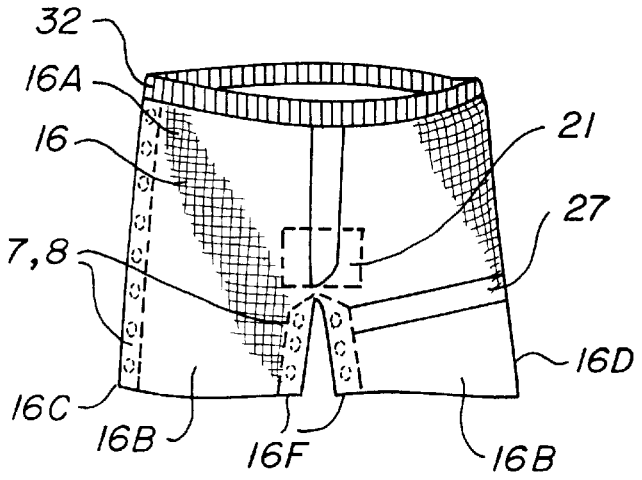
FIG. 2 is a perspective view of the shorts according to the inventive device.
Figure 3:
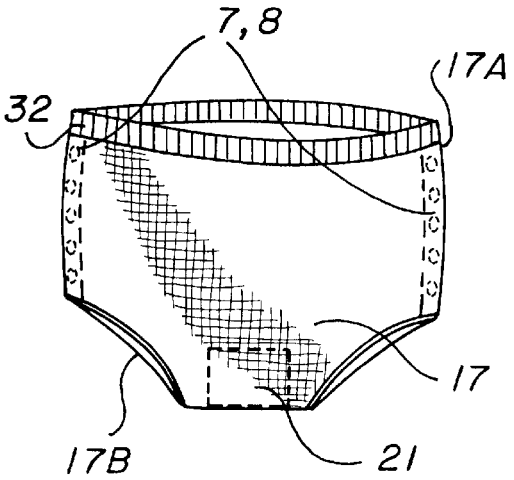
FIG. 3 depicts an undergarment according to the present invention.
Figure 4:
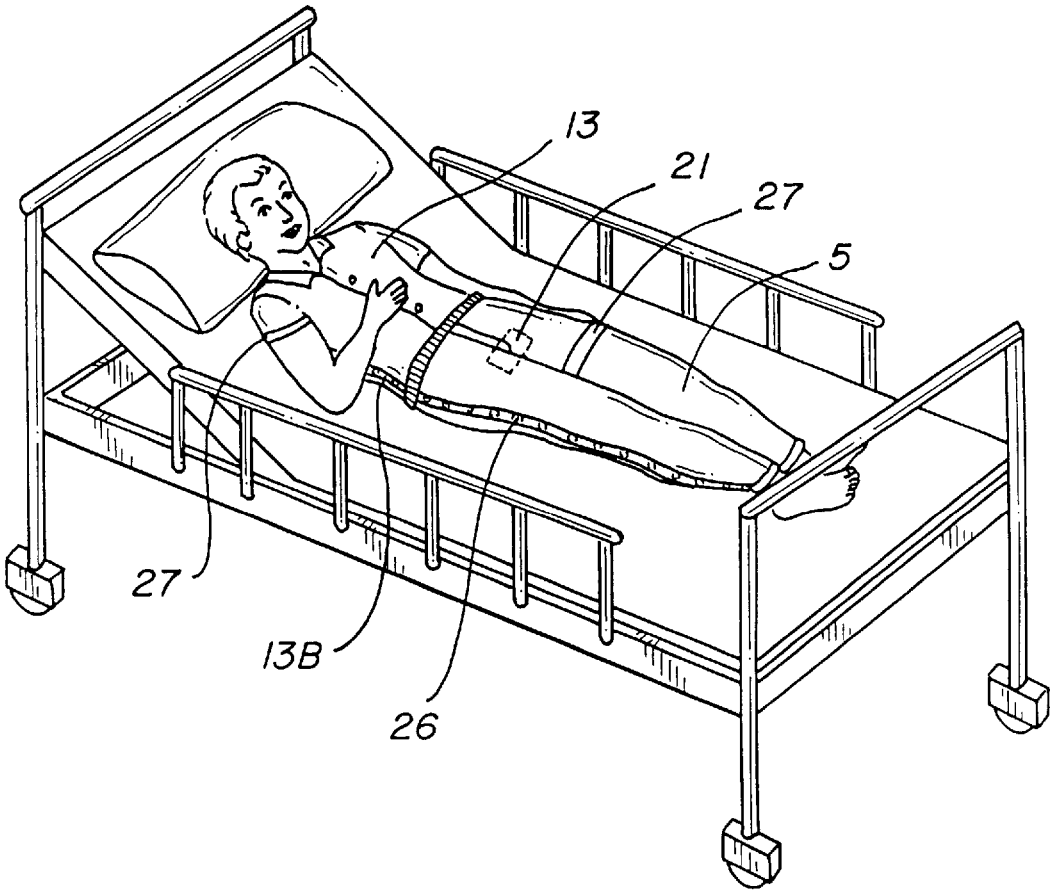
FIG. 4 depicts the shirt and trousers on a bedridden patient.
Figure 5:
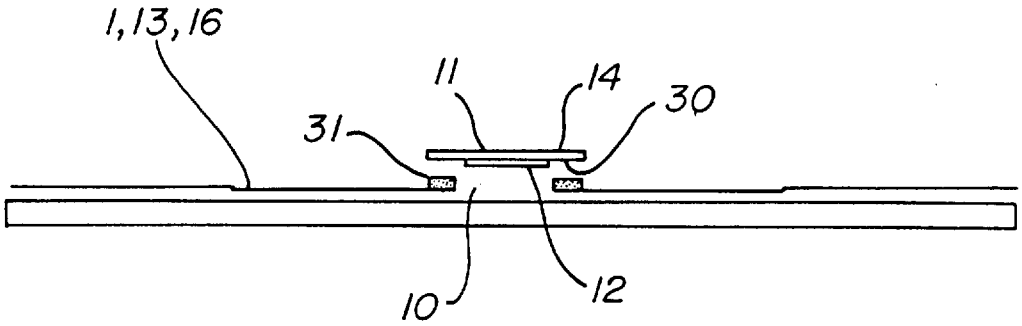
FIG. 5 is a cross sectional view of a garment surface depicting the aperture and liquid crystal thermometer received therein.
Figure 6:
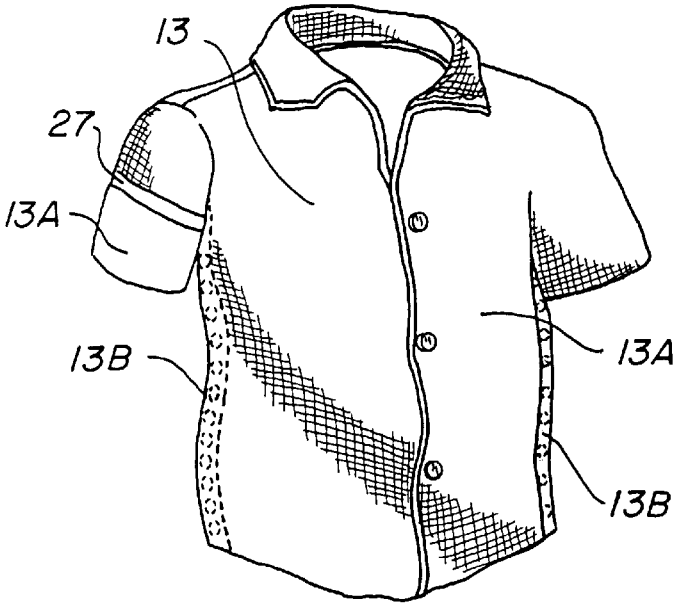
FIG. 6 depicts the shirt component.
Figure 7:
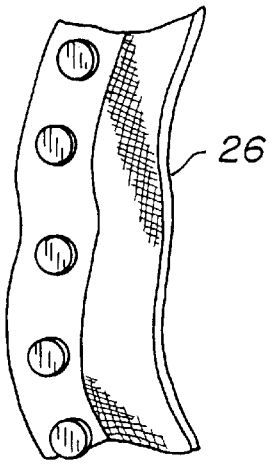
FIG. 7 is a detailed view of the button mechanism and adjacent flap.

Referring now to FIGS. 1 through 8, the present invention relates to various articles of removable clothing such as undergarments, trousers, shorts and shirts designed for bedridden patients. The trousers 1 comprise a lower torso portion 2 with first 5 and second leg portions 3 extending therefrom. Each leg portion 3,5 has a longitudinal inner leg seam 3A and a diametrically disposed longitudinal outer leg seam 3B.

The trousers 1 are formed from a fabric shell comprising two half-trouser sections permanently attached to each other at a first leg 5 outer seam 3B. The two inner seams 3A on the first 5 and second 3 leg portions and the outer seam 3B on the second leg portion 3 are separable using a plurality of attachment means.

Each half trouser section has first and second inner leg seam edges and a second outer leg seam edge each of which attaches to a corresponding seam edge on the opposing half-trouser section. The seams are joined using a plurality of buttons 7 longitudinally disposed along the first inner seam edges 3A and the outer first seam edge 3B of the second leg portion 3 on a half trouser section while mating apertures 8 for removably receiving the buttons 7 are similarly disposed on the opposing half-trouser section. Accordingly, the three leg seams are readily separable allowing the trousers to be easily removed from an incapacitated patient. As will be readily apparent to those skilled in the art, the attachment means described is not limited to buttons and apertures. Other suitable attachment means such as Velcro®, zippers, snaps, etc. may be used without departing from the spirit of the present invention. Immediately adjacent each series of buttons 7 and disposed a predetermined distance from the first seam edge is a longitudinal strip 26 of fabric having a predetermined width dimensioned to conceal each releasable seam.

Disposed on one of the leg portions is an aperture 10 received within which is a substantially circular, planar liquid crystal thermometer 11 having top and bottom surfaces. Protruding from the bottom surface is a circular projection 12 to which a temperature measuring means is attached. The projection 12 ensures that the temperature measuring means completely protrudes through the aperture and firmly engages a person's skin. Attached to the top surface of the thermometer is a liquid crystal display 14 for indicating the patient's body temperature. On the bottom surface of the thermometer adjacent the projection 12 is a suitable attachment means such as Velcro® 30 for engaging a similar attachment means 31 disposed on the exterior surface of the trousers proximal the aperture 10. The thermometer 11 is secured within the aperture and held firmly against the patient's skin using a continuous elastic band 27 which surrounds a leg portion and engages the top surface of the thermometer.

Figure 8:
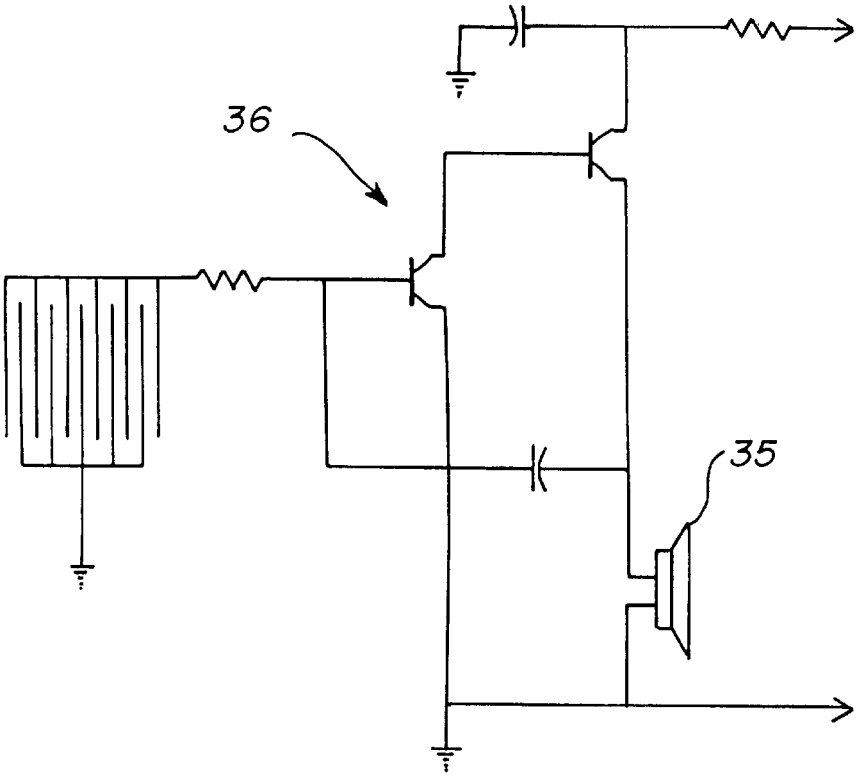
FIG. 8 depicts a schematic of the moisture detector circuitry.

On the interior surface of the lower torso portion proximal the groin area is a moisture sensing device 21 of the type generally known in the prior art in communication with a speaker 35. The speaker emits an audible noise upon a sensing pad detecting a predetermined amount of moisture. When moisture contacts the sensing pad, an audio oscillating circuit 36 is formed causing the alarm to be triggered. The moisture sensing circuit is depicted in FIG. 8.

The shorts 16 resemble the trousers and comprise a lower torso portion 16A with a pair of leg portions 16B, shorter than those of the trousers, extending therefrom. Each leg portion 16B has separable inner seams 16F similar to those on the trousers with one separable 16C and one permanently attached 16D outer leg seam. The shorts also have a moisture sensor 21 proximal the groin area and an aperture for receiving a liquid crystal display thermometer 11. As with the trousers, an elastic band 27 is provided to retain the thermometer 11 within the aperture.

The shirt component 13 comprises an upper torso portion with a pair of opposed sleeve portions 13A extending therefrom. Immediately below each of the opposed sleeve portions along opposite sides of the upper torso portion are separable vertical seams 13B. The seams comprise a series of buttons 7 and mating apertures 8 similar to those found on the trousers. The shirt component 13 likewise has an aperture on a sleeve portion for receiving a thermometer 11 as described above. An elastic band 27 is provided to retain the thermometer within the aperture.

The undergarment 17 has a body portion with a pair of leg openings thereon 17B and a groin area therebetween. The undergarment 17 has a pair opposed separable seams that originate at a waist line 17A area and terminate at the leg openings 17B. The undergarment may also have a moisture detector 21 proximal the groin area.

A releasable glove component (not pictured) may also be provided. Each glove component would resemble a typical glove having a hand portion with a plurality of finger portions extending therefrom. Either of opposing sides of the hand portion may have a separable seam as described above. Furthermore, a pair of jogging or warm-up pants may also be provided which are designed similarly to the trousers.

The trousers, short pants and undergarment components each have an elastic or similar type waist band 32 to secure them about a user's waist. The trousers and jogging pants may also have an elastic band or similar device at a distal end of each leg position for securing the leg portions to a wearer's ankles. The above described garments are preferably manufactured with a durable, washable fabric. Each garment fabric is pretreated with an anti-bacterial, an anti-fungal and/or an anti-viral agent such as, but not limited to, bithionol, tetraclorophene or similar agents designed to aid in the prevention of bed sores, skin rashes, etc. The size, shape, style, color and similar properties of the individual clothing may be varied to suit a particular application.

Although there has been shown and described the preferred embodiment of the present invention, it will be readily apparent to those skilled in the art that changes may be made thereto which do not exceed the scope of the appended claims. Accordingly, the scope of the invention is only be limited by the following claims.

What is claimed is:

1. Releasable trousers for surrounding a lower body portion of an incapacitated or bedridden patient comprising:

a fabric shell having interior and exterior surfaces with a lower torso portion, first and second leg portions extending therefrom, and groin area therebetween; said shell having a separable inner seam on said first leg portion, separable inner and outer seams on said second leg portion, each separable seam comprising first and second removably attached edges; one of said leg portions having an aperture thereon;

a temperature sensing means received within said aperture and removably attached to said leg portion for contacting a person's skin and measuring the temperature thereof when said fabric shell is surrounding a body portion.

2. A device according to claim 1 wherein said separable seams comprise:

a plurality of aligned buttons along the first edge of each separable seam;

a plurality of apertures disposed along the second edge of each separable seam, said apertures dimensioned to receive said buttons.

3. A device according to claim 1 further comprising a moisture sensing means attached to the interior surface of said fabric shell proximal said groin area.

4. A device according to claim 3 wherein said moisture sensing means comprises a moisture detector circuit in electrical communication with a moisture pad and a sound emitting means for delivering an audible alarm upon sensing a predetermined amount of liquid.

5. A device according to claim 1 wherein said temperature sensing means comprises:

a substantially circular liquid crystal display thermometer having bottom and top surfaces;

a substantially circular projection extending from its bottom surface having a temperature measuring means thereon, said projection dimensioned to extend through said aperture so that said temperature measuring means contacts said body portion of an incapacitated patient.

6. A device according to claim 5 wherein said temperature sensing means has a temperature indication means on its top surface.

7. A device according to claim 1 further comprising a continuous elastic band for surrounding a leg portion and for retaining said temperature sensing means within said aperture and for holding the temperature sensing means firmly against the body portion of an incapacitated patient.

8. A device according to claim 2 wherein a fabric flap is longitudinally disposed along the first edge of each separable seam portion dimensioned to conceal said buttons.

9. A releasable shirt for surrounding the upper body portion of an incapacitated or bedridden patient comprising:

an upper torso portion with two opposed sleeve portions extending therefrom, one of which has an aperture thereon;

separable seams along opposing sides of the upper torso portion, said separable seams each comprising first and second removably attached edges;

a temperature sensing means received within said aperture and removably attached to said sleeve portion for contacting a person's skin when said shirt component is surrounding an upper body portion.

10. A device according to claim 9 wherein said separable seams comprise:

a plurality of aligned buttons along the first edge of each separable seam;

a plurality of apertures disposed along the second edge of each separable seam, said apertures dimensioned to receive said buttons.

11. A device according to claim 9 wherein said temperature sensing means comprises:

a substantially circular liquid crystal display thermometer having bottom and top surfaces;

a substantially circular projection extending from its bottom surface having a temperature measuring means thereon, said projection dimensioned to protrude through said aperture so that said temperature measuring means contacts the upper body portion of the patient.

12. A device according to claim 11 wherein said temperature sensing means has a temperature indication means on its top surface.

13. A device according to claim 9 further comprising a continuous elastic band for surrounding a sleeve portion and for overlaying said temperature sensing means to retain said temperature sensing means within said aperture and for holding the temperature sensing means firmly against the body portion of an incapacitated patient.

* * * * *